United States Patent [19]

Smith, Jr.

[11] 3,949,668

[45] Apr. 13, 1976

[54] LIQUID FEED FOR OFFSET PRESS DAMPENING SYSTEM

[75] Inventor: Roy R. Smith, Jr., Leawood, Kans.

[73] Assignee: Smith R.P.M. Corporation, Lenexa, Kans.

[22] Filed: Oct. 17, 1974

[21] Appl. No.: 515,688

[52] U.S. Cl. ..... 101/148; 101/366

[51] Int. Cl.[2] ..... B41F 7/30

[58] Field of Search ..... 101/147, 148, 366, 364; 118/302, 312, 313; 239/124, 125, 127

[56] References Cited

UNITED STATES PATENTS

| | | | |
|---|---|---|---|
| 1,185,667 | 6/1916 | Hoe | 101/366 X |
| 1,185,668 | 6/1916 | Hoe | 101/366 X |
| 1,924,731 | 8/1933 | Barnes | 101/366 |
| 2,389,730 | 11/1945 | Iler | 101/147 |
| 3,023,968 | 3/1962 | Mitchell | 239/125 |
| 3,065,693 | 11/1962 | Neal et al. | 101/366 |
| 3,341,124 | 9/1967 | Barnes | 239/124 X |
| 3,348,774 | 10/1967 | Wiggins | 118/302 X |
| 3,450,092 | 6/1969 | Kock | 118/302 X |
| 3,529,626 | 9/1970 | German | 239/124 X |
| 3,651,756 | 3/1972 | Smith, Jr. | 101/147 |

*Primary Examiner*—J. Reed Fisher

*Attorney, Agent, or Firm*—Fishburn, Gold & Litman

[57] ABSTRACT

A multiple spray nozzle, offset press dampening system of the type having individual metering pumps for the respective nozzles achieves improved control and reliability by substantially increasing feed water pressure entering the metering pumps, thereby reducing the formation of bubbles. The pump output valve flow-through pressure is also increased to retain accurate metering conditions.

5 Claims, 6 Drawing Figures

LIQUID FEED FOR OFFSET PRESS DAMPENING SYSTEM

This invention relates to lithographic printing dampening apparatus of the type utilizing individual metering pumps for each spray nozzle, and more particularly, to improvements in the liquid feed system therefor.

The concept of multiple spray nozzle dampening systems wherein individual metering pumps were provided for the respective nozzles was disclosed in U.S. Pat. No. 3,651,756 issued Mar. 28, 1972 and provided a significant improvement in the lithographic dampening art, permitting fine control for optimum dampening under highly varied conditions of press speed, paper and ink requirements. The apparatus disclosed therein has been highly satisfactoy for a substantial range of printing requirements, however, control was occasionally found to be inadequate for producing extremely high quality printing, as on fine, coated papers. It has now been determined that at least a portion of the control inadequacy has been caused by tiny bubbles collecting in the output chambers of the metering pumps during printing runs and slightly interfering with the accuracy of pump discharge.

The gross bubble problem was previously recognized and, as described in said U.S. Pat. No. 3,651,756, system priming structure has been provided to eliminate any such bubbles during press start-up and, with common printing requirements, during the run. However, the use of such a priming device during a very high quality printing run would tend to vary moisture delivery to an extent which is unacceptable. The improvement described herein produces a pre-determined increase in moisture feed pressure upstream from and within the metering pump, thereby substantially inhibiting any tendency for bubble formation or entry in the metering pumps.

The principal objects of the present invention are: to provide a dampening apparatus and method for offset printing presses which permit extremely fine moisture flow control suitable for the highest quality printing; to provide such apparatus which is relatively inexpensive to manufacture and easily adapted to the printing press; to provide such an apparatus and method which substantially reduces or eliminates metering pump output variations caused by bubbles within pump chambers; to provide such apparatus which may be easily added to both new and existing multi-pump, offset press dampening systems; and to provide such apparatus which is highly reliable and requires a minimum amount of attention for operation and maintenance.

Other objects and advantages of this invention will become apparent from the following description taken in connection with the accompanying drawings wherein are set forth, by way of illustration and example, certain embodiments of this invention.

Figure 1:
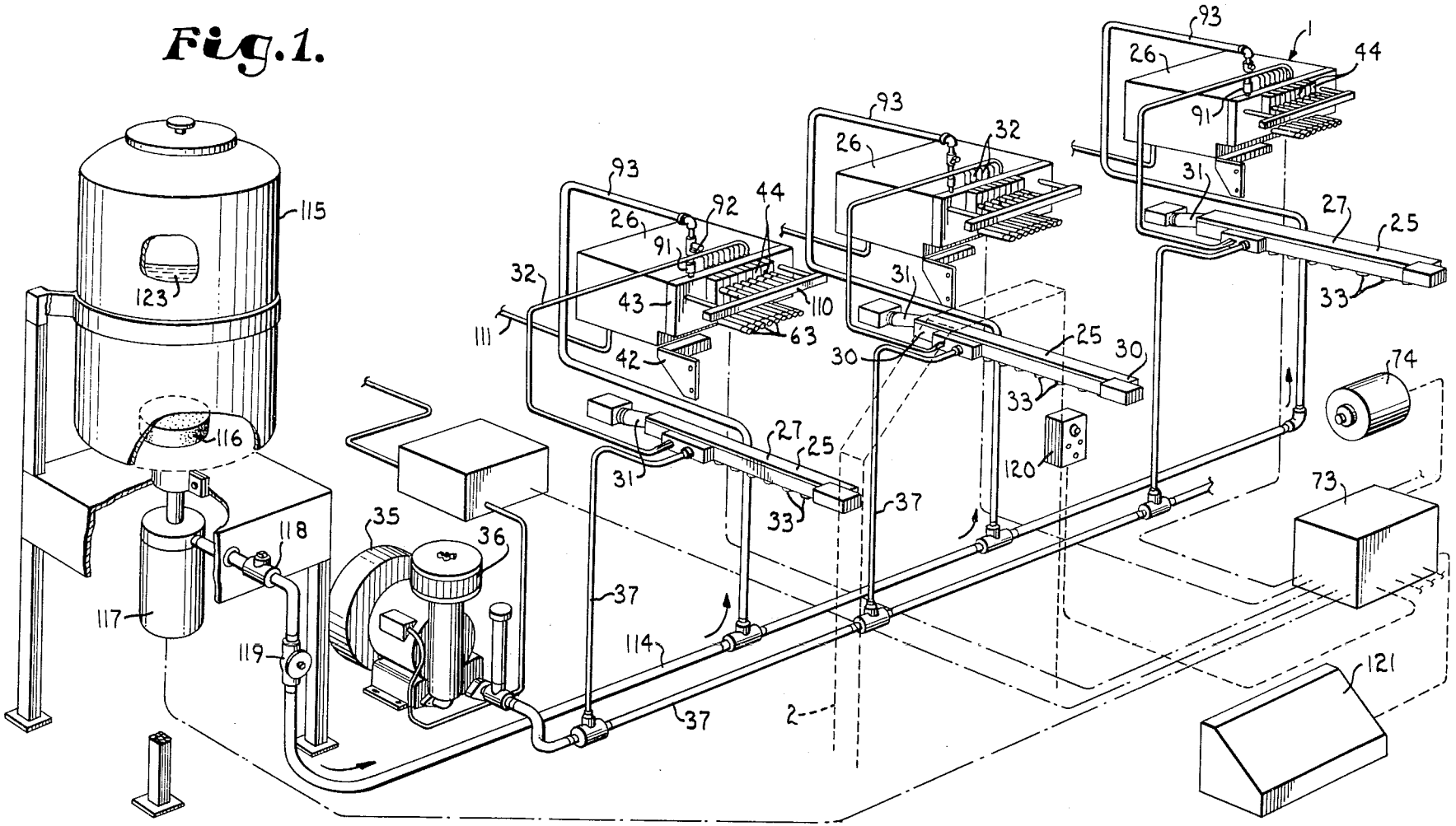
FIG. 1 is a partially schematic, perspective view showing a spray dampening system embodying this invention, spray apparatus for three printing towers being illustrated.

Referring to the drawings in more detail:

The reference numeral 1 generally indicates an example of improved dampening apparatus embodying this invention. The apparatus 1 is illustrated for use on a rotary, offset, web printing press 2 (FIG. 2) of a conventional type having an ink transfer train 3 including an ink fountain 4, hard rollers 5–9 and relatively soft (e.g., rubber) rollers 10–17. By means of the ink transfer train 3, ink 18 in the fountain 4 is transferred and evenly distributed to a lithographic printing plate 19 on a plate roller 20. The ink 18 adheres to the plate 19 only at predetermined locations, and the ink image thereby formed is transferred to a blanket cylinder 21. The image is deposited from the cylinder 21 upon a moving paper web 22 which is maintained in plate contact by means of an impression cylinder 23. The rollers and cylinders above noted are driven directly or indirectly through typical press drive means (not shown) which synchronize the described printing operation with additional printing towers and various known operating devices in a well-known manner.

Referring to this invention, the apparatus 1 includes a spray bar or member 25 mounted on respective towers of the press 2 adjacent the ink transfer train 3 and a pump assembly or member 26 mounted in spaced relation to the spray member 25 but connected thereto with multiple, liquid carrying hoses as described below.

Figure 2:
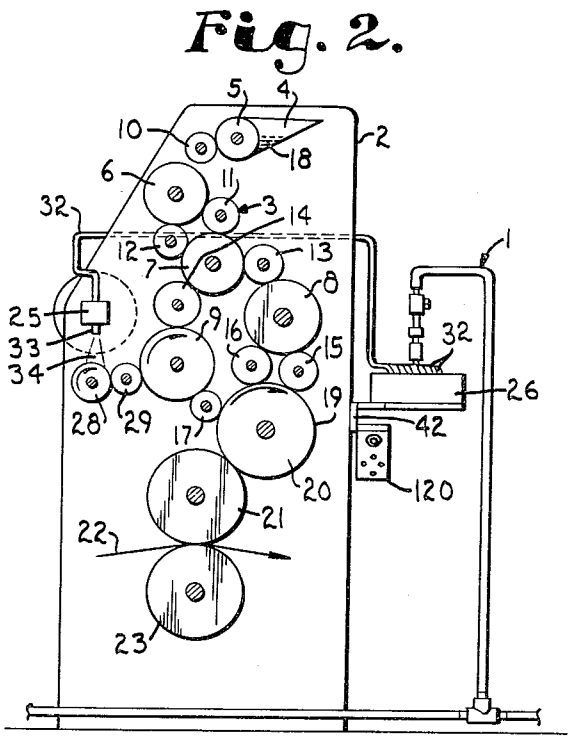
FIG. 2 is a partially schematic, fragmentary side elevation showing the system in conjunction with a typical printing tower.

The spray member 25 has an elongated body portion 27 mounted on the press 2 longitudinally adjacent selected dampener rollers 28 and 29 (FIG. 2). The body portion 27 is suitably secured at opposite ends 30 thereof by means of swinging support arms 31 suitably pivotally anchored to the frame of the printing tower.

Figure 6:
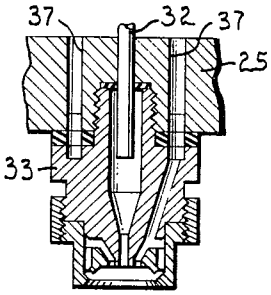
FIG. 6 is a fragmentary, cross-sectional view, on a substantially enlarged scale over FIG. 1, illustrating a typical spray nozzle.

The spray members 25 contain conduits or passageways (not shown) directing individual hoses 32 to respective spray nozzles 33 (FIG. 6) which are secured in laterally spaced relation on the body portion 27 (FIG. 1). In this example, the spray nozzles 33 are directed generally toward the nip formed between the dampener rollers 28 and 29, however, it is to be understood that substantial variations in the spray disposition arrangement may be utilized, depending upon many variable factors and press designs, so long as the spray 34 remains operatively directed to travel toward the plate cylinder 19 (FIG. 2).

The spray nozzles 33 are characterized as having unvalved liquid exit openings, as is more clearly described in said U.S. Pat. No. 3,651,756. In this example, a blower 35 (FIG. 1) draws air through a cleaning filter 36 and directs it, under pressure, within a suitable duct system 37 to the spray members 25 for promoting atomized liquid flow out of the respective spray nozzles 33.

The pump member 26 comprises a frame 41 mounted, in this example, by means of a bracket 42 to a convenient location on the frame of the tower in the vicinity of the spray member 25. The frame 41 includes a manifold block or portion 43 (FIG. 3) into which the individual spray nozzle hoses 32 communicate as described further below. A pump valve block 44 is provided for each of the nozzles 33 and includes a pump recess 45 extending thereinto from an exterior surface 46, the recess 45 here being formed by bores extending through the block. The blocks 44 are mounted by suitable screws 47 onto the manifold portion 43 with the recess 45 pressed against an exterior surface 48 of the manifold portion 43. A plurality of bores 49 extend in laterally spaced relation through the manifold portion 43 and are respectively axially aligned with the pump recesses 45. Flexible diaphragm seals or pump means 50 are positioned between the respective recess 45 and the bores 49, effectively isolating them from each other.

Plungers 51 are reciprocably received in the respective manifold portion bores 49 and exhibit a forward rounded end 52 bearing against one side of the respective diaphragm seal 50. The bores 49 decrease in diameter near the rounded ends 52 forming a guide passageway for the plungers as well as a peripheral shoulder for supporting the diaphragm seals 50.

The plungers 51 include diametricallly reduced projections 53 extending axially opposite to the rounded ends 52 and beyond the exterior surface 54 of the manifold portion 43. The projections 53 are received into sockets 55 located in drive ends 56 of respective rocker arms 57. The rocker arms 57 each have an adjusting end 58, opposite from the drive end 56, and containing a socket 59 opening laterally in the same direction as the socket 55. A fulcrum rod 60 is suitably anchored with respect to the frame 41 and extends along the manifold portion 43, engaging the rocker arms 57 at points intermediate the ends 56 and 58.

The sockets 59 receive the tips 61 of adjusting members 62, each having a handle 63 and a threaded extension 64 received in a threaded bores 65 extending through the manifold portion 43. The tips 61 bear against the rocker arm adjusting end 58, thereby adjustably limiting the length of the reciprocal stroke which can be taken by the respective plungers 51. A suitable detent 66 is resiliently urged against the handle 63 and is selectively received in circumferentially spaced notches 67 for maintaining the adjusting member in a desired rotary position, but permitting easy readjustment by manual rotation of the handle.

A drive shaft 68 is rotatably mounted on the pump member 26 and extends along the respective rocker arms 57. A plurality of bearings 69 have eccentric inner races 70 and are spaced along the drive shaft 68 aligned with each of the arms 57. Cylindrical spacers 71 fit over the bearings 69 and are effectively positioned adjacent the back side 72 of the rocker arm drive ends 56. The races 70 are eccentric with the axis of the drive shaft 68, for example, 1/32 of an inch, whereby, upon proper adjustment, the rotation of the shaft reciprocably drives the plunger 51 through the rocker arm drive ends 56, although the spacers 71 may remain rotationally stationary. A suitable variable speed motor (not shown) is preferably mounted within the pump member 26 and in driving engagement with the shaft 68. The motor effects rotation of the shaft 68 at a desired speed suitably associated with the speed of the printing press by appropriate control circuits contained, for example, in an enclosure 73, receiving speed information from a tachometer signal generator 74 rotated by the press drive (not shown).

In the valve block 44, a flat-headed pin 78 is located in the pump recess 45 and bears against the front surface of the diaphragm seal 50. The body of the pin 78 is received axially within a helical compression spring 79 which urges the pin against the seal by bearing against a screw plug 80. The screw plug 80 and diaphragm seal 50 are spaced apart and sealed with respect to the pump recess 45, forming a pump chamber 81 therebetween.

Figure 5:
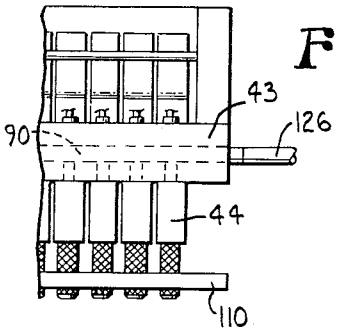
FIG. 5 is a fragmentary plan view showing a bank of metering pumps and particularly illustrating the flow path for the recirculation achieved in the modified form of FIG. 4.

Lower and upper passageways 82 and 83 communicate into the pump chamber 81 and also, respectively, into an intake valve chamber 84 and an output valve chamber 85 formed in the respective lower and upper portions of the valve blocks 44. The intake valve chamber 84 has a valve seal or disc 86 resiliently seated therein by means of a helical spring 87 compressed thereagainst with a threaded seal plug 88. The intake valve chamber 84 communicates through a pump input portion, or bore 89, with a manifold passageway 90 (FIGS. 3 and 5) formed in the manifold portion 43. The manifold passageway 90 is branched along its length, thereby communicating with each bore 89 in the respective valve blocks 44. The manifold passageway 90 is fed dampening liquid through a suitable plumbing fitting 91 incorporating a manual shut-off valve 92 and communicating with a feed hose 93 described further below. The fitting 91 communicates with the manifold passageway 90 through a passageway 94 (FIG. 3) in the manifold block or portion 43.

The output valve chambers 85 have valve seals or discs 99 resiliently seated therein or loaded by means of helical springs 100 bearing thereagainst through pressure exerted by threaded plugs 101 having central passageways therethrough. The passageways in the plugs 101 provide communication between the valve chambers 85 and respective passageways 102 in the manifold portion 43. The passageways 102 receive the input ends of the respective hoses 32, sealing therewith through suitable O-rings 103 maintained in sealing engagement through pressure exerted by a block 104 secured to the manifold portion 43 by screws 105.

The output valve chambers 85 have piston rods 106 received partially thereinto and slidably sealed through O-rings 107 maintained under compression with threaded collars 108. Helical compression springs 109 surround the piston rods 106 and normally urge same away from the valve disc 99. A transverse bar 110 bears against each of the piston rods 106 and is adapted, by suitable means such as an air cylinder (not shown) contained in the pump member 26 and actuated by a compressed air line 111, to move the pistons 109 simultaneously into the output valve chambers 85, resulting in discharging substantially the entire contents of the respective output valve chambers.

The feed hoses 93 extend from the fitting 91 and communicate with a main dampener liquid supply hose 114 which is fed, in this example, from a supply tank 115 through a filter 116, pressure pump 117, check valve 118 and pressure regulator 119. The pump 117 is actuated, together with the blower 35 and the printing press drive, by suitable press switches and controls 120 and 121 and functions to raise the pressure in the hoses 114 and 93 to a predetermined amount above atmospheric. The check valve 118 prevents reverse flow, thus maintaining the pressure in the closed liquid feed system, even during periods when the pump 117 is temporarily not actuated. The regulator 119 is utilized to adjustably control pressure downstream therefrom to a desired predetermined amount, however, it is to be understood that a separate regulator may be unnecessary if the output from the pump 117 is otherwise maintained (regulated) at the desired pressure.

The spring 87 in the intake valve chamber 84 is relatively low in compressive force, bearing on the valve disc 86 lightly, but sufficiently to create a seal in absence of a differential pressure on opposite sides thereof. In contrast, the spring 100 bearing against the output valve disc 99, is relatively strong whereby a relatively high pressure is required within the pump for liquid flow to occur past the valve disc 99 and into the hoses 32.

The pressure in the supply hose 114 and feed hoses 93 is controlled by the regulator 119 to an amount which is easily sufficient to drive liquid past the respective intake valve disc 86 but insufficient to drive liquid also past the output valve disc 99. Thus, elevated pressure is constantly maintained in the system from the supply hose 114, through the feed hoses 93, internal passageways and chambers of the valve block 44 to the inner face of the output valve disc 99. The reciprocation of the plungers 51, through rotation of the drive shaft 68, produces added pressure within the pump arrangement, opening the output valve disc 99 upon each pump stroke and producing metered liquid flow out the hose 32. However, pressure, even on the suction stroke does not fall below a predetermined elevated amount above atmospheric within the pump due to the liquid feed pressure.

Thus bubbles 124, which may tend to form from dissolved gas in the liquid due to liquid turbulence, temperature changes, chemical reactions and/or pressure drops, will not be permitted to form, due to the elevated pressure, until the liquid is past the output valve disc 99 where they will be harmlessly discharged through the nozzles 33 without interference with the metered liquid discharge of the pump.

The bar 110 may be utilized, as desired, to flush the output valve chamber 85 during start-up of the press, especially when the press has not been operated for an extended period of time and pressure may have bled down in the liquid supply network. The use of the bar 110 is also sometimes desirable to supply the relatively heavy moisture demands immediately on start-up, however, such flushing will normally be unnecessary during the press run.

Although particular pressures within the system may be varied, it has been found that a suitable operational arrangement utilizes a metering pump intake valve requiring one to two psig to open, a metering pump output valve requiring approximately 10 psig to open and a liquid pressure regulator set to maintain, in cooperation with the source feed pump, approximately 5 psig in the liquid supply network.

Figure 3:
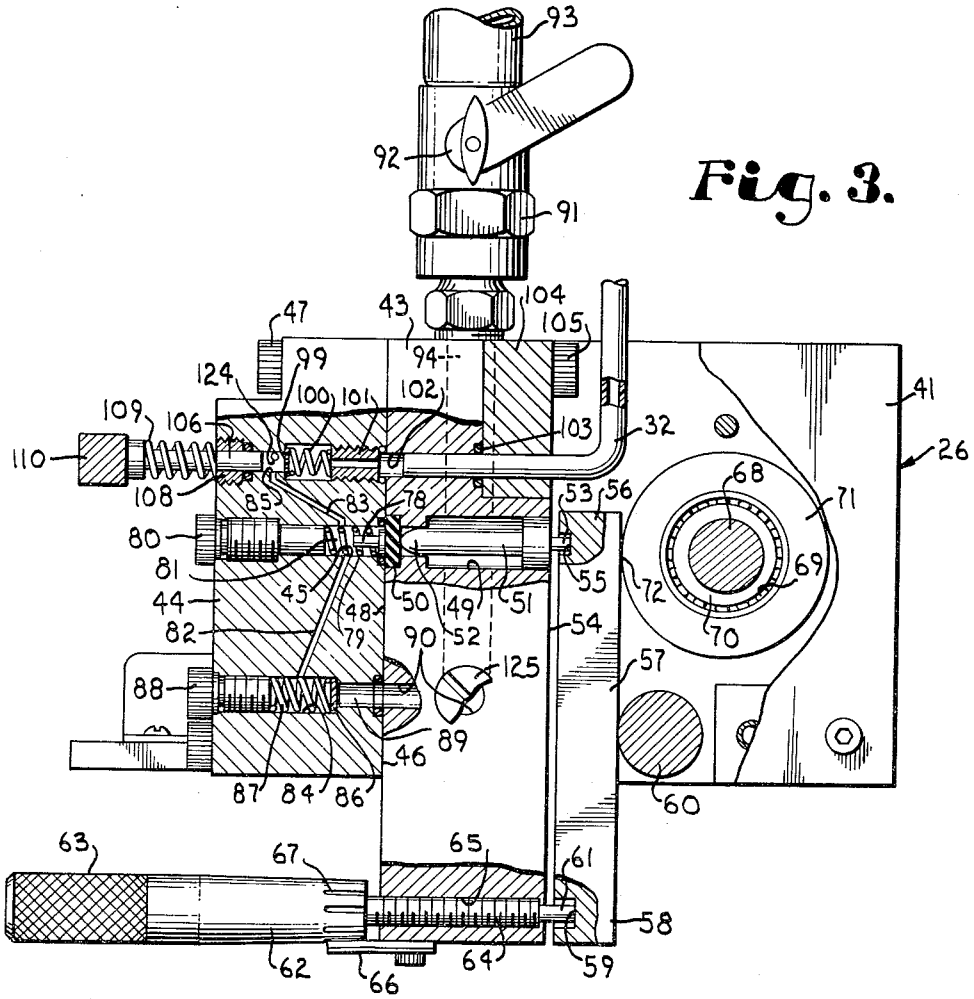
FIG. 3 is a fragmentary side elevation, on a substantially enlarged scale over FIG. 1, with portions broken away, illustrating the internal structure of a metering pump.
Figure 4:
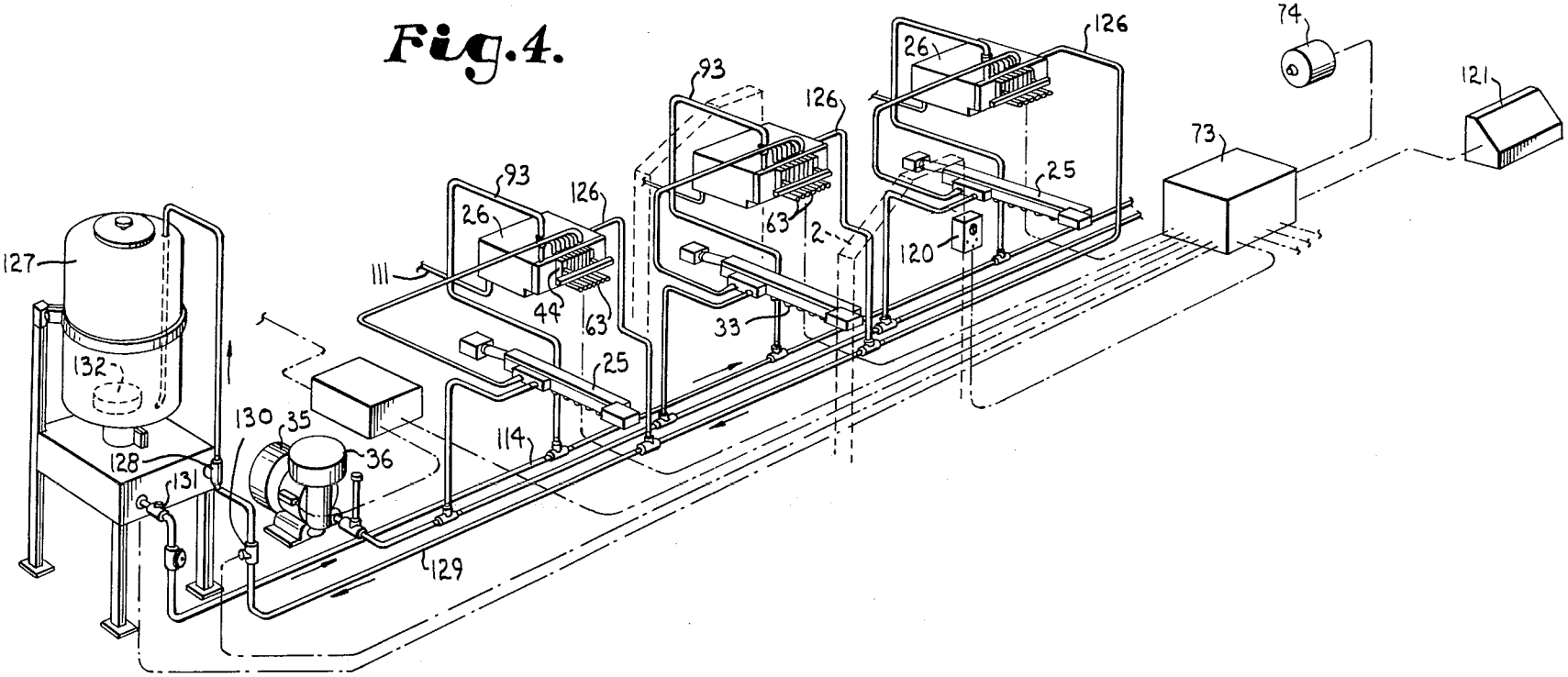
FIG. 4 is a partially schematic, perspective view similar to FIG. 1 but illustrating a modified form of this invention wherein excess dampening liquid is circulated back to its source.

Referring to FIG. 4, a modified form of this invention is depicted which is similar to that described above with the exception that the passageway 90 (FIG. 5) is not dead-ended, as by the plug 125 used in the embodiment of FIG. 3, but rather is connected to an outlet hose 126 through which the unused portion of the dampening liquid is recirculated back to the supply tank 127. In this embodiment a suitable hose or line restriction 128 is placed in the main return hose 129 so that the desired pressure may be retained in the system while circulation is obtained. A solonoid check valve 130 is also placed in the return hose 129 to block flow completely when the press is deactuated, thereby producing cooperation with the check valve 131 for maintaining pressure in the liquid feed system.

With the embodiment of FIG. 4 excess liquid flowing through the dampening feed system is constantly agitated, recirculated and directed through the filter 132, thereby further reducing the possibility of bubble formation or the introduction of solid particles which may interfere with proper system operation.

It is to be understood that, although certain forms of this invention have been illustrated and described, it is not to be limited thereto except insofar as such limitations are included in the following claims.

What is claimed and desired to secure by Letters Patent is:

1. For use in combination with an offset printing press, a lithographic dampener system, said dampener system comprising:

a. a spray member having a plurality of dampening liquid atomizing spray nozzles, individual dampening liquid output conduit means connected at one end thereof to said nozzles, b. a pump member having a plurality of individual, bubble sensitive, reciprocal metering pumps respectively including an input portion containing a loaded input valve and an output portion containing a loaded output valve loaded to a substantially greater opening pressure than said input valve and a pump pathway extending between said input and output valves, c. said output conduit means being connected at the other end thereof to said respective metering pump output portions, reciprocating metering pump means communicating with said pump pathway between said input and output valves and alternately increasing and decreasing the dampening liquid volume of said pump pathway, d. a source of dampening liquid suseptible to bubble formation therein, input conduit means connected between said liquid source and said respective input portions, a feed pump operably located in said input conduit means, and e. pressure regulator means associated with said feed pump and together controlling the feed pressure of said dampening liquid into said respective input portions to a point substantially above atmospheric pressure and greater than that required to open said loaded input valve but less than the sum of the opening pressures of said input plus output valve, thereby causing said dampening liquid to be maintained substantially above atmospheric pressure during flow from said feed pump and through said metering pumps, whereby bubbles tending to form in said dampening liquid are urged to remain in solution permitting accurate metering by said respective reciprocal metering pumps.

2. The dampener system as set forth in claim 1 including:

a. a return passageway connected between said metering pumps and said source and circulating excess dampening liquid back to said source.

3. The dampener system as set forth in claim 2 including:

a. a restriction in said return passageway and adapted to prevent excess pressure drop upstream therefrom.

4. The dampener system as set forth in claim 1 wherein:

a. a check valve is operably positioned downstream from said feed pump and upstream from said respective input portions, b. said check valve inhibiting pressure drop between said check valve and said respective output valves.

5. The dampener system as set forth in claim 1 wherein:

a. said input valves are loaded to an opening pressure of approximately 1 to 2 psig, b. said output valves are loaded to an opening pressure of approximately 10 psig, and c. said feed pump and regulator means maintain said feed pressue at approximately 5 psig.

* * * * *